US005348362A

United States Patent [19]

Rolls

[11] Patent Number: 5,348,362

[45] Date of Patent: Sep. 20, 1994

[54] PORTABLE CARRIER FOR WIRES, HOSES AND THE LIKE

[76] Inventor: James B. Rolls, 9201 Mabley Hill Rd., Fenton, Mich. 48430

[21] Appl. No.: 967,416

[22] Filed: Sep. 28, 1992

[51] Int. Cl.[5] ..... A45F 5/10

[52] U.S. Cl. ..... 294/151; 294/157; 294/165

[58] Field of Search ..... 294/31.2, 151, 153, 294/154, 155, 156, 157, 163, 165; 248/76, 77, 78, 82

[56] References Cited

U.S. PATENT DOCUMENTS

| | | | |
|---|---|---|---|
| 504,307 | 8/1893 | Roberts | 294/157 X |
| 1,175,024 | 3/1916 | Thorson | 294/157 X |
| 2,308,744 | 1/1943 | Buys | 294/31.2 X |
| 3,012,809 | 12/1961 | Tremaine | 294/157 X |
| 3,942,636 | 3/1976 | Matsuyama et al. | 294/156 X |
| 4,402,542 | 9/1983 | Kreutzer | 294/156 |
| 4,796,936 | 1/1989 | Sherin | 294/151 X |
| 4,832,398 | 5/1989 | Tecca et al. | 294/31.2 X |
| 4,842,158 | 6/1989 | Reyes, Jr. | 294/31.2 X |
| 5,096,248 | 3/1992 | Ryan | 294/156 |

*Primary Examiner*—Dean J. Kramer

[57] ABSTRACT

A carrier for supporting a coil formed from a length of wire or hose comprising: an arcuately shaped supported member defining a top support surface and a bottom support surface; a plurality of fasteners secured to a top surface at ends of the support member for holding the coil to the bottom surface of the support member, the fastener including a flexible strap looped under the coil.

13 Claims, 2 Drawing Sheets

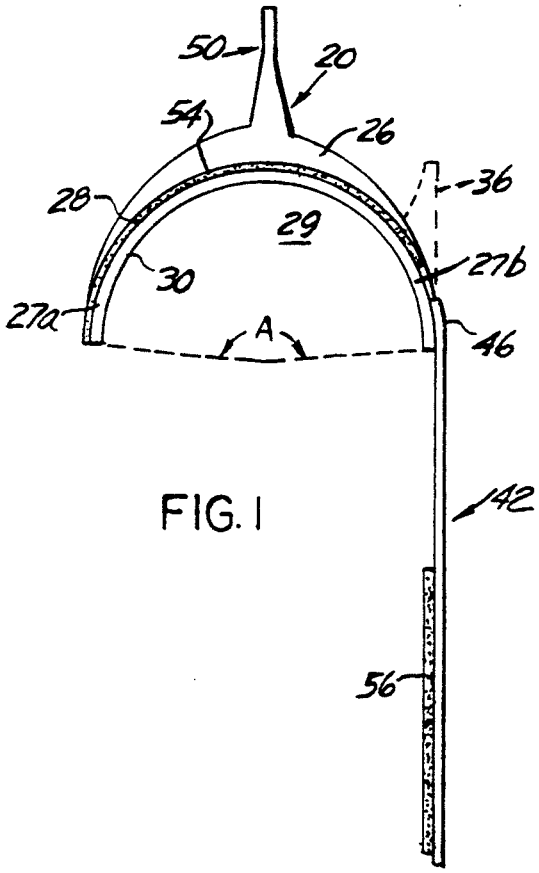
FIG. 1
FIG. 2
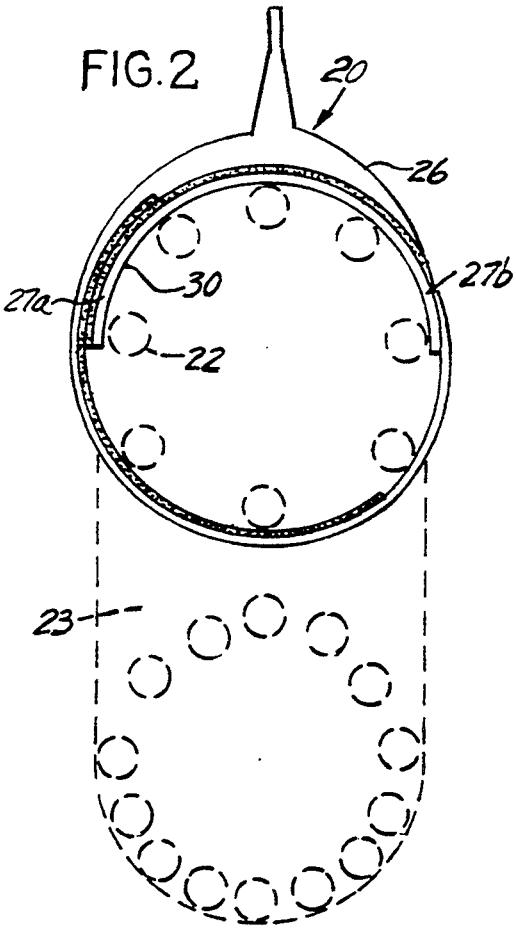
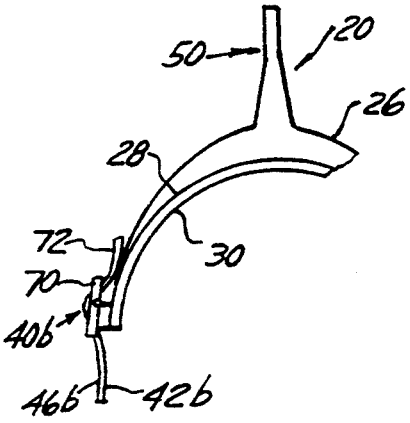
FIG. 6
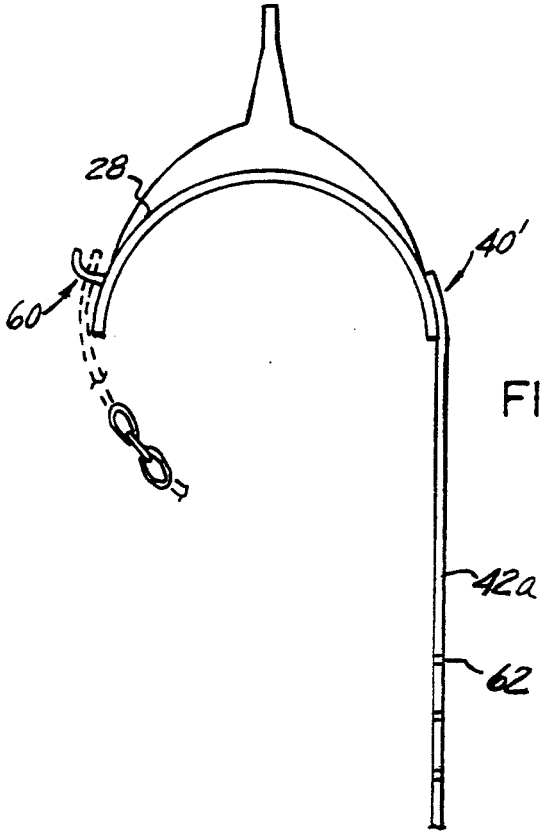
FIG. 5

FIG. 3
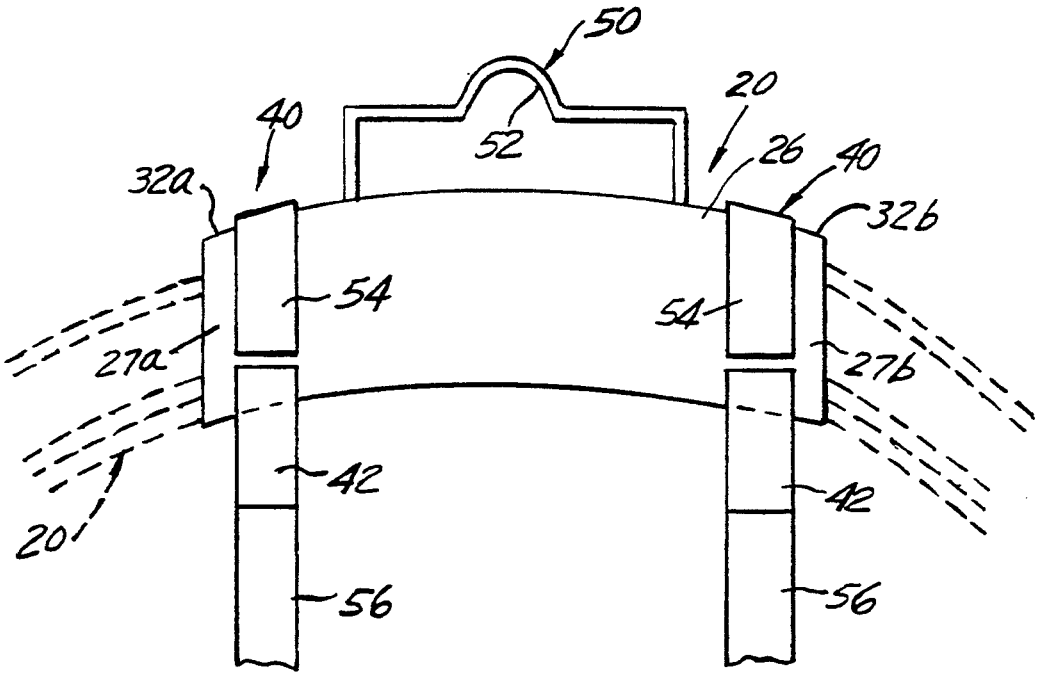
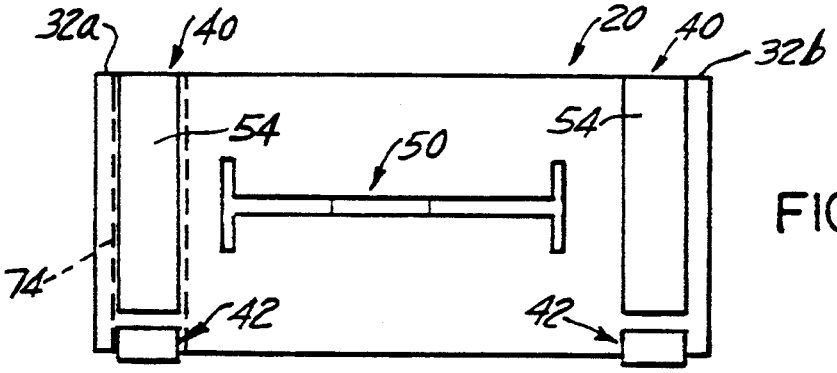
FIG. 4
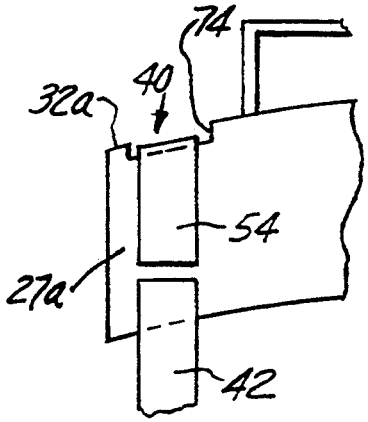
FIG. 7

PORTABLE CARRIER FOR WIRES, HOSES AND THE LIKE

BACKGROUND AND SUMMARY OF THE INVENTION

The present invention relates to a device for carrying and supporting a coil of wire or hose.

It is advantageous, that after an electrical wire or water hose has been coiled to maintain the wire or hose in its coiled configuration for storage or transport.

It is an object of the invention to provide an improved portable carrier for wires and hoses.

Accordingly the invention comprises: a carrier for supporting a coil formed from a length of wire or hose, comprising: an arcuately shaped support member defining a top support surface and a bottom support surface, fastening means secured to the top surface at ends thereof for fastening the coil against the bottom surface of the support member. The fastener means includes in one embodiment a strap looped under the coil. In the preferred embodiment the top surface is flat and curved downwardly giving the support member a trough-like shape. The fastener means may comprise, in addition to the strap, chain, wire, Velcro patches, or hooks and corresponding holes formed in the strap in addition to a buckle and tongue.

Many other objects and purposes of the invention will be clear from the following detailed description of the drawings.

BRIEF DESCRIPTION OF THE DRAWINGS

In the drawings:

FIG. 1 illustrates a side view of a carrier made in accordance with the present invention.

FIG. 2 is another side view of the carrier showing a coil of wire or hose in phantom line.

FIG. 3 illustrates a left side view of a carrier.

FIG. 4 is a top view of a carrier.

FIG. 5 illustrates an alternate embodiment of the invention.

FIG. 6 illustrates a further alternate embodiment of the invention.

FIG. 7 shows an additional embodiment of the invention.

DETAILED DESCRIPTION OF THE DRAWINGS

With reference to FIGS. 1–4 there is shown a carrier 20, preferably constructed of plastic, rubber, nylon or metal for supporting a coil 22 of a wire or hose. The carrier 20, in its preferred embodiment, comprises an arcuately shaped support member 26 having outwardly extending arms 27*a,b*. Each arm is formed by a top surface 28 and a bottom surface 30. In the illustrated embodiment the surfaces 28 and 30 are curve downwardly to subtend an angle, A, of for example, about 20–180 degrees forming a cylindrical trough 29. As can be appreciated the length of the arms 27*a,b* corresponds to the size of the angle A. Extending upwardly from the support member 26 is a handle 50 which may be integrally formed as part of the support member. As shown the handle 50 extends parallel to the axis 27 of the support member 26 but could be rotated to be perpendicular to the axis. The handle can be a separate element and it may be desirable to swivel mount the handle to the support member 26. The carrier 20 may also include a flat edged bracket 36 extending upwardly from one side of the support member 26 as shown in FIG. 1 in phantom line. The bracket 36 may be integrally formed as part of the structure. The bracket 36 provides a means by which the carrier 20 may be hung on a cooperating structure. The bracket may include a mounting hole or a hook extending through or from its flat edge.

Secured proximate each end 32*a* and 32*b* of the support member is a corresponding fastener 40. As illustrated in FIG. 2 each fastener 40 includes a first lock portion 54, a flexible strap 42 and a second lock portion 56. In the illustrated embodiment the first lock portion 54 comprises a patch 54 of a female section of Velcro which extends across most of the top surface and the second lock portion comprises a patch 56 of a male section of Velcro attached to an end of a strap 42. The other end 46 of the strap 42 is secured to the support member 26. After the wire of hose 22 is coiled it is placed against the bottom surface 30 (see FIG. 2), i.e. within the trough 29, with the coil extending outwardly along the arms 27*a,b*. Thereafter each strap 42 is brought under the loop 23 formed in the coil 22 of the wire of hose, pulled taut and the patch 56 of Velcro secured to the other patch 54 on the top surface of the support member 26. As can be appreciated the carrier 20 can support coils of varying thickness due to the orientation of the components of the fastener 40. FIG. 3 shows another embodiment of the invention in which a handle includes a portion 52 to enable the carrier to be hung on a cooperating structure.

FIG. 5 illustrates another embodiment of the invention showing a different fastener 40' where the Velcro patches 54 and 56 have been replaced. The first lock portion 54 is now formed by a hook 60 attached to the top surface 28 of the support member 26. The second lock portion 56 is formed as a plurality of holes 62 formed in the strap 42*a*. The locked position of the strap 42*a* to one of the hooks 60 is shown in phantom line in this FIGURE. FIG. 5 also diagrammatically shows that the strap can be replaced by a chain or wire 42'.

FIG. 6 shows a further embodiment of a fastener 40*b* in which the first lock portion 54 is formed as a buckle 70 and the second lock portion 56 is formed as a tongue 72 on the end 46*b* of the strap 42*b*. In any of the above embodiments any of the fasteners can be located in a slot or channel 74 formed across the top surface 28 of the structure 26 as shown in FIG. 7. In this manner the various elements of the fasteners can be recessed below the top surface yielding a more streamline appearance.

Many changes and modifications in the above described embodiment of the invention can, of course, be carried out without departing from the scope thereof. Accordingly, that scope is intended to be limited only by the scope of the appended claims.

I claim:

1. A carrier (20) for supporting a coil (22) wound in a predetermined direction, the carrier comprising:

a support member (26) comprising a first and second open ends, extending along the predetermined direction, a bottom surface and a center portion, a first side member (27*a*) curved convex downward from the center portion and terminating at a first side edge, a second side member (27*b*) curved convex downward from the center portion and terminating at a second side edge, the first and second side members extending between the first and second opens ends and further curved convex downward therebetween to form an open ended trough

(29) between the first and second open ends and first and second side edges for receipt Of the coil;

fastener means (40), for holding the coil (22) in the trough, against the bottom surface (30) of the support member (26), including a first lock means (54) proximate each end (32*a,b*) of the support member (26), and first loop means (42) for being looped under the coil (22) for supporting the coil and engagable with the first lock means.

2. The carrier (20) as defined in claim 1 including a handle ( 50 ) extending from the support member.

3. The carrier (20) as defined in claim 2 wherein the handle (50) includes a hoop portion (52) to enable the carrier to be hung on a cooperating structure.

4.The carrier (20) as defined in claim 1 wherein the fastener means includes second lock means (56) attached to the first loop means, wherein one end of the first loop means is secured to the top surface of the support member (26).

5. The carrier (20) as defined in claim 4 wherein the first lock means includes a first Velcro patch attached to the support member (26) and wherein the second lock means includes a second Velcro patch secured to an end (46) of the first loop means (42).

6. The carrier (20) as defined in claim 4 wherein the first lock means includes a hook (60) secured to the support member and wherein the second lock means includes a plurality of holes (62) formed in the first loop means and engagable with the hook.

7. The carrier (20) as defined in claim 6 wherein the first loop means includes a flexible strap.

8. The carrier (20) as defined in claim .6 wherein the first loop means includes a section of chain.

9. The carrier (20) as defined in claim 4 wherein the first lock means includes a buckle (70) secured to the support member and wherein the second lock means includes a tongue (72) formed at an end of the first loop means engagable with the buckle.

10. The carrier (20) as defined in claim 1 wherein the side edges of the support member subtend an angle, A, between about 20 and 180 degrees.

11. The carrier (20) as defined in claim 1 including bracket means, integrally formed as part of the support structure (26) rigidly and fixedly extending upwardly therefrom for enabling the carrier to be mounted to a cooperating structure.

12. The carrier (20) as defined in claim 1 wherein the first loop means includes a length of wire or chain.

13. The carrier as defined in claim 1 wherein the top surface of the side members (27 *a,b*) each include a groove for receiving a first lock means.

* * * * *